United States Patent [19]

Manservisi et al.

[11] 4,364,464

[45] Dec. 21, 1982

[54] APPARATUS FOR THE FORMATION OF CIGARETTE GROUPS

[75] Inventors: Renato Manservisi; Antonio Zullo, both of Bologna, Italy

[73] Assignee: Cir S.p.A. Divisione Sasib, Bologna, Italy

[21] Appl. No.: 142,997

[22] Filed: Apr. 23, 1980

[30] Foreign Application Priority Data

Apr. 27, 1979 [IT] Italy ..... 12563 A/79

[51] Int. Cl.[3] ..... B65B 19/10

[52] U.S. Cl. ..... 198/419; 53/150; 53/151; 414/30; 414/32

[58] Field of Search ..... 414/30, 32, 33; 53/148, 53/149, 150, 151, 444; 198/419, 420

[56] References Cited

U.S. PATENT DOCUMENTS

| | | | |
|---|---|---|---|
| 150,549 | 5/1874 | Ewing . | |
| 353,866 | 12/1886 | Kinney et al. | |
| 1,393,642 | 10/1921 | Rose . | |
| 1,639,429 | 8/1927 | Ekström et al. | |
| 1,647,265 | 11/1927 | Bronander . | |
| 1,706,716 | 3/1929 | Voigt . | |
| 1,765,820 | 6/1930 | Bronander et al. | |
| 1,868,583 | 7/1932 | Örström . | |
| 1,870,533 | 8/1932 | Scott et al. | |
| 1,984,808 | 12/1934 | Popov . | |
| 2,234,142 | 11/1943 | Arelt | 53/151 X |
| 2,621,840 | 12/1952 | Kemp | 53/149 |
| 3,365,857 | 1/1968 | Liedtke . | |
| 3,435,940 | 4/1969 | Seragnoli | 198/419 |
| 3,603,445 | 9/1971 | Zausch et al. | 198/419 |
| 3,608,270 | 9/1971 | Rudszinat et al. . | |

FOREIGN PATENT DOCUMENTS

| | | | |
|---|---|---|---|
| 1912651 | 10/1970 | Fed. Rep. of Germany | 198/419 |
| 2327916 | 12/1973 | Fed. Rep. of Germany | 53/151 |
| 2243911 | 3/1974 | Fed. Rep. of Germany | 53/150 |

*Primary Examiner*—Leslie J. Paperner
*Attorney, Agent, or Firm*—Spencer & Kaye

[57] ABSTRACT

Apparatus for the formation of cigarette groups consisting of three superposed parallel rows of cigarettes comprising three row-forming stations which receive the cigarettes from passageways connected to a feeding hopper. Associated with each row-forming station there is an intermediate transfer drum which presents a plurality of transfer pockets adapted to receive the rows of cigarettes from the row-forming stations. The cigarettes are then transferred from the pockets of the transfer drums into the receiving pockets of a receiving drum. Each transfer drum supplies to the receiving pockets of the receiving drum a definite row of cigarettes, so that at the end of an operating cycle, the receiving pockets will be filled with three superposed rows of cigarettes. From the receiving pockets, the groups of cigarettes are transferred to a compressor drum, associated with a cigarette packing machine. The transfer drums, the receiving drum and the compressor drum are rotated stepwise in synchronism.

3 Claims, 4 Drawing Figures

APPARATUS FOR THE FORMATION OF CIGARETTE GROUPS

BACKGROUND AND SUMMARY OF THE INVENTION

The present invention relates to cigarette packing machines and more particularly has for its object an improved apparatus for the formation of regular groups or blocks of cigarettes to be packed.

There are known apparatuses in which a regular block of cigarettes, consisting for example of three superposed rows of respectively seven, six and seven cigarettes, is formed by separately preparing, at different row-forming stations, the rows of cigarettes, and by transferring simultaneously the single cigarette rows into receiving containers, subsequently arranged on a suitable endless conveyor, such as for example a chain conveyor or a rotary drum, which is moved with stepwise movement.

A known apparatus of the above described type is illustrated, for example, in the U.S. Arelt Pat. No. 2,334,142, precisely for the formation of a cigarette block composed of twenty cigarettes, arranged in three superposed rows of seven, six and seven cigarettes.

The feed hopper comprises twenty passageways divided into groups of seven, six and seven passageways, for feeding the single cigarettes, by gravity, to three separate row-forming stations, which are practically defined each by the abutment plate at the bottom end of the passageways. A stepwise-rotary drum is arranged for rotation before the row-forming stations, so as to bring a series of receiving pockets mounted thereon and provided with partitions for the cigarette rows, in axial alignment with the row-forming stations. During a dwell phase of the rotary drum, the receiving pocket aligned with the middle row-forming station receives the six-cigarettes row, while the receiving pockets at the right and at the left receive the bottom and top rows formed each of seven cigarettes, so that upon rotation of the drum, there is finally formed, in each pocket, a block of cigarettes of three superposed rows of seven, six and seven cigarettes, as desired.

The known apparatus of the above type presents some inconveniences, particularly when it is desired to employ it in association with high speed packing machines.

Firstly, there is required a tapered conduit or tubing acting as intermediary for the transfer of the cigarette row from the row-forming station into the receiving pocket of the receiving drum, said tapered conduit or tube being necessary to move laterally the cigarettes of a row so to bring them close to each other: in fact, when the cigarettes reach the row-forming station, there is a certain amount of side clearance between each of them, due to the total thickness (although kept to a minimum) of the partition walls forming the passageways from the hopper to the row-forming station. The use of the mentioned tapered conduit or tube, interposed between the row-forming station and the receiving pocket, requires a longer stroke of the ejector plates or pushers which effect the transfer of the row of cigarettes from the station to the receiving pocket.

Another limitation of the known type apparatuses resides in the fact that some of the passageways for the feeding of the cigarettes from the hopper to the row present a substantial inclination with respect to the vertical, which inclination slows down the descent by gravity of the cigarettes along the said passageways, and consequently the overall speed of the apparatus.

According to the invention, the apparatus for the formation of blocks of cigarettes does not effect directly the transfer of the cigarette rows from the row-forming stations into the receiving pockets of the receiving drum, said transfer being instead effected with the interposition of intermediate transfer drums, in the number of one for each row-forming station, each transfer drum being provided with a series of transfer pockets arranged angularly equispaced on the periphery of the drum, said transfer pockets coming successively into alignment with the row-forming station for receiving a row of cigarettes and in alignment with the receiving pockets on the receiving drum, for transferring the said row into the appropriate pocket. In this manner, the stroke of the ejector plate or pusher which transfers the row of cigarettes from the row-forming station to the transfer pocket of the intermediate transfer drum, and the stroke of the ejector plate or pusher which transfers the row of cigarettes from the transfer pocket into the receiving pocket of the receiving drum, are sensibly reduced with respect to the stroke which would be required by the ejector plate of the known type apparatuses, which transfers directly the cigarettes from the row-forming station to the receiving pocket, by passing also through the tapered conduit or tube.

According to another characteristic feature of the invention, which is rendered possible by the presence of the intermediate transfer drums, the row-forming stations are arranged in a horizontal plane. In this manner, the partition walls defining the passageways for the cigarettes from the hopper to the said row-forming forming station can be made vertical or slightly inclined with respect to the vertical, and can terminate at a certain distance from the cigarette abutment plate of the row-forming station, without any possibility of rolling of the cigarettes, and the said cigarettes can be brought together in close side-to-side relationship by any suitable means such as joggers of known type.

BRIEF DESCRIPTION OF THE DRAWINGS

The apparatus according to the invention will be now described with reference to the attached drawings, in which.

DESCRIPTION OF THE PREFERRED EMBODIMENT

Figure 1:
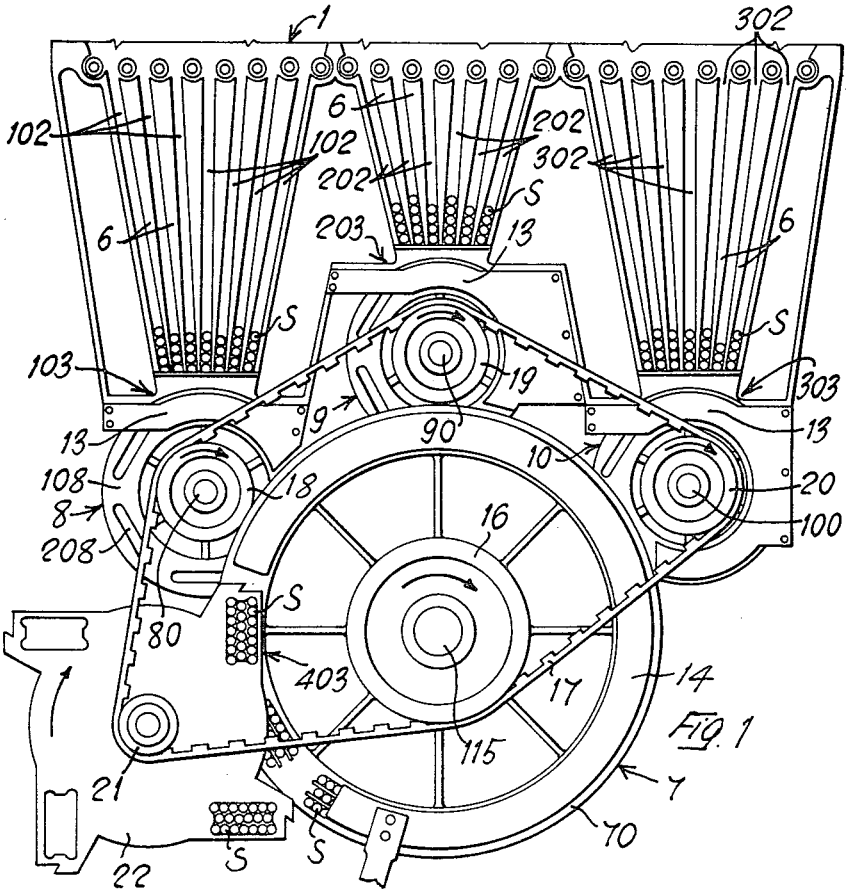
FIG. 1 is a front elevation view of the apparatus for forming cigarette blocks.
Figure 4:
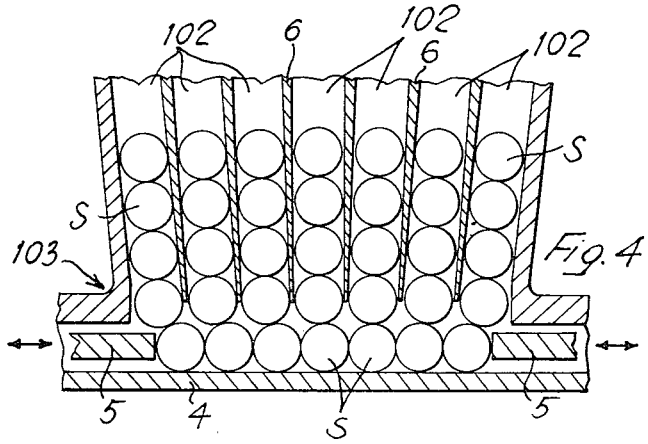
FIG. 4 is a front section, in an enlarged scale, of a detail of a station for the formation of a row of cigarettes.
Figure 2:
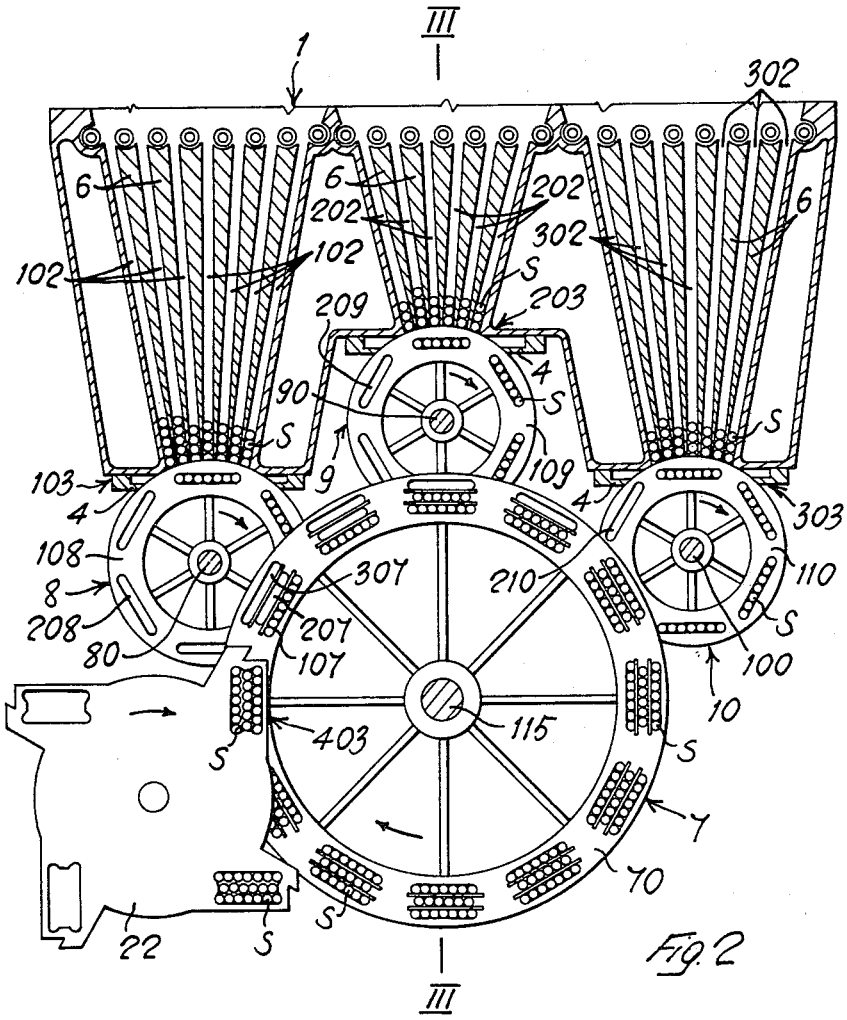
FIG. 2 is a view similar to FIG. 1, with parts removed and parts sectioned, for a better understanding of the construction and operation of the apparatus.
Figure 3:
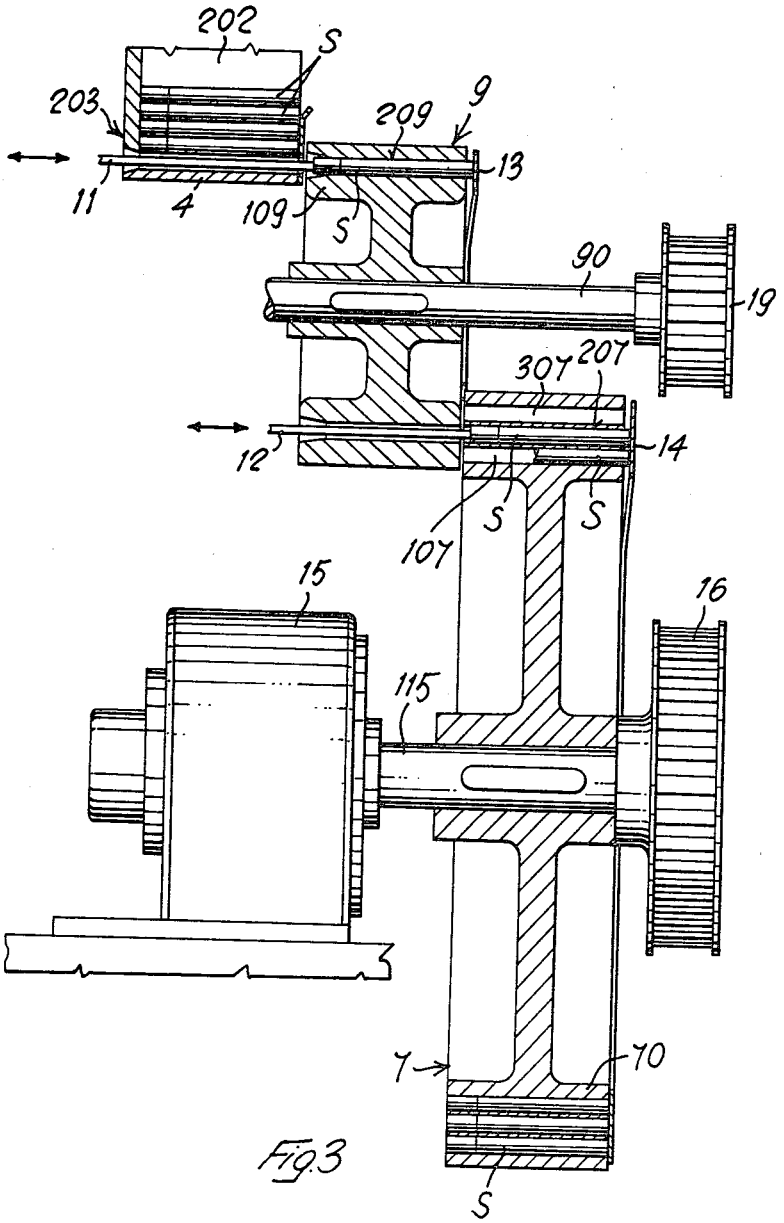
FIG. 3 is a transverse section along line III—III of FIG. 2.

In the drawings, there is shown an apparatus which forms groups or blocks of 20 cigarettes, each block being composed of three superposed rows having seven cigarettes in each of the two outer rows and six cigarettes in the middle row. The cigarettes S are contained in a gravity hopper 1 and from the bottom of this hopper are fed into the passageways 102, 202, 302. More precisely, the said passageways are divided in three sections, the first section 102 comprising seven passageways, the second or intermediate section 202 comprising six passageways, and the third section 302 comprising again seven passageways. The said three sections of passageways 102, 202 and 302 terminate respectively at three horizontal row-forming stations 103, 203 and 303, for the formation of horizontal rows of seven, six and seven cigarettes. Each row-forming station (see particularly FIG. 4 where, by way of example, there is illustrated the row-forming station 103) is open at the front and rear ends and it presents a collecting space inside which there is formed each single row, said collecting space being closed at the bottom by the abutment plate 4, laterally by the side joggers 5 and being defined, at the top, by the terminal edges of the partition walls 6 of the passageways 102 (202, 302). The cigarettes S coming from the passageways 102 present a certain amount of side clearance between each other, when resting on the abutment plate 4. The timed intervention of the joggers 5 (as shown in FIG. 4) eliminates this clearance and brings the cigarettes in close side-to-side contact, ready for being transferred without the need of tapered compression conduits or tubes.

The rows of cigarettes S formed at each row forming station 103, 203, 303 must be transferred to the receiving pockets 107, 207, and 307 respectively of the rotary receiving drum 7, said receiving pockets 107, 207, 307 being separated, in a known manner, by suitable partition walls, so as to define three separate superposed spaces to be filled by three rows of cigarettes for the formation of a block of twenty cigarettes to be packed into a cigarette package.

In accordance with the present invention, for transferring the rows of cigarettes S from the row-forming stations 103, 203, 303 there is provided, associated with each row-forming station, an intermediate transfer drum 8, 9, 10, these intermediate transfer drums being stepwise rotated in synchronism with the stepwise rotary movement of receiving drum 7, as will be described hereafter.

More particularly, to the row-forming station 103 there is associated the transfer drum 8, which is provided at its periphery 108 with six transfer pockets 208, open at the front and rear end and angularly equispaced according to the sides of a hexagon.

The transfer drum 8 is rotated stepwise, with a ratio of rotation of 2:1 with respect to receiving drum 7. In the peripheral or crown portion 70 of the receiving drum 7 there are obtained twelve triplets of superposed open ended receiving pockets 107, 207, 307. The said triplets are arranged according to the sides of a regular dodecagon. The transfer drum 8 is dimensioned and positioned in such a manner that when a receiving pocket 208 is aligned with the row-forming station 103, another receiving pocket 208 located two steps forward in the direction of rotation of the transfer drum 8, is aligned with the receiving pocket 107 of the receiving drum 7.

In a similar manner, the transfer drums 9 and 10, identical to drum 8, are associated respectively to the row-forming stations 203 and 303. The transfer pockets 209, 210 obtained respectively on the peripheries or crowns 109, 110 of the said transfer drums 9 and 10, come to be aligned respectively with the row-forming stations 203, 303 and with the receiving pockets 207, 307 of drum 7.

The transfer of the cigarette rows from the row-forming stations 103, 203, 303 into the respective transfer pockets 208, 209, 210 of the transfer drums 8, 9, 10 is effected, simultaneously, during a dwell phase of said transfer drums, by the ejector plates 11, through suitable control means (not shown). Simultaneously with the above mentioned transfer of the cigarette rows from the row-forming stations to the transfer pockets of the transfer drums, also the transfer of the rows of cigarettes from the transfer pockets 208, 209, 210 of the said transfer drums to the receiving pockets 107, 207, 307 of the receiving drum 7 is effected, under the action of the ejector plates 12, actuated by suitable control means (not shown). The actuation of the ejector plates 11 and 12 can be simultaneous, or individual. In a similar manner, a single actuation control can be provided for each pair of ejector plates 11, 12.

At the station 403 of the rotary transfer drum 7, an ejecting plunger (not shown) sequentially transfers the cigarette blocks (20 cigarettes in three superposed rows) into the transfer pockets of a compressor device 22, which may be of any known type, which has the purpose of compressing the cigarette blocks so as to facilitate their introduction into the hollow arbors of the packing machine, also constructed and operating in a known manner.

The cigarettes which might project from the outlet end of the transfer pockets 208, 209, 210 of the transfer drums 8, 9, 10 are correctly aligned with their ends on an even surface under the action of the levelling side guides 13 (one for each transfer drum 8, 9 and 10), while the levelling side guide 14 in a similar manner alignes on an even surface the ends of the cigarettes contained in the receiving pockets 107, 207, 307 of the receiving drum 7.

The several drums of the cigarette block-forming apparatus are driven into stepwise rotation by a driving device 15 of any known type, which presents a driving shaft 115 onto which there is keyed the receiving drum 7, and a driving pulley 16 for a chain or toothed belt 17. The toothed belt 17 simultaneously engages the toothed pulleys 18, 19, 20 keyed respectively on the shafts 80, 90, 100 of the transfer drums 8, 9, 10 and the toothed pulley 21, which promotes the rotation of the compressor device 22.

It appears evident that, in the above described cigarette-block forming apparatus, the passageways 102, 202, 302 for feeding the cigarettes to the row-forming stations are vertical or just slightly inclined with respect to the vertical, so that the descent by gravity of the cigarettes S down along the said passageways takes place uniformly and with the maximum speed. Moreover, the strokes of the ejector plates 11, 12 are reduced greatly (up to one half) with respect to the strokes of ejector plates (pushing members) in apparatuses of the known type, where tapered conduits or tubes are provided at the outlet ends of the row-forming stations, and the cigarette rows must pass, being pushed by the said ejector plates, through the said intermediate conduits or tubes, which increases the length of the stroke (and consequently the time of intervention) of the said ejector plates or pushers. Consequently, the just described apparatus is suitable for use in high speed packing machines.

We claim:

1. Apparatus for the formation of cigarette groups each consisting of at least two parallel superposed rows of cigarettes, said apparatus including a feed hopper; a plurality of passageways for each of said rows of cigarettes, said passageways receiving cigarettes from said feed hopper; a row-forming station, open at both ends, terminating each of said pluralities of passageways; and a rotatable receiving drum having a plurality of angularly equispaced groups of receiving pockets, wherein the improvement comprises:

an intermediate transfer drum for each of said row-forming stations positioned between an associated row-forming station and said receiving drum, each of said intermediate transfer drums having a plurality of angularly equispaced transfer pockets open at both ends and adapted to receive a cigarette row, said intermediate transfer drums being rotated in synchronism with said receiving drum so that each transfer pocket of each intermediate transfer drum is brought successively into alignment, at different angular positions, with a corresponding row-forming station and with a receiving pocket of said receiving drum;

first pusher means for pushing cigarette rows from said row-forming stations into the transfer pockets of said intermediate transfer drums; and second pusher means for pushing cigarette rows from the transfer pockets of said intermediate transfer drums into the receiving pockets of said receiving drum;

wherein each of said plurality of passageways is defined by partition walls extending downward from said hopper; and wherein each of said row-forming stations is positioned in a horizontal plane and comprises a horizontal abutment plate spaced from the lower end of said partition walls to form an open ended collecting space in which a single row of cigarettes is formed in a horizontal plane, and a jogger at each end of said collecting space movable in synchronism with the movement of said first pusher means.

2. Apparatus for the formation of cigarette groups each consisting of at least two parallel superposed rows of cigarettes, said apparatus including a feed hopper; a plurality of passageways for each of said rows of cigarettes, said passageways receiving cigarettes from said feed hopper; a row-forming station, open at both ends, terminating each of said pluralities of passageways; and a rotatable receiving drum having a plurality of angularly equispaced groups of receiving pockets, wherein the improvement comprises:

an intermediate transfer drum for each of said row-forming stations positioned between an associated row-forming station and said receiving drum, each of said intermediate transfer drums having a plurality of angularly equispaced transfer pockets open at both ends and adapted to receive a cigarette row, said intermediate transfer drums being rotated in synchronism with said receiving drum so that each transfer pocket of each intermediate transfer drum is brought successively into alignment, at different angular positions, with a corresponding row-forming station and with a receiving pocket of said receiving drum;

first pusher means for pushing cigarette rows from said row-forming stations into the transfer pockets of said intermediate transfer drums; and second pusher means for pushing cigarette rows from the transfer pockets of said intermediate transfer drums into the receiving pockets of said receiving drum;

wherein each of said plurality of passageways is defined by partition walls extending downward from said hopper; and wherein each of said row-forming stations comprises a horizontal abutment plate spaced from the lower end of said partition walls to form an open ended collecting space in which a single row of cigarettes is formed, and a jogger at each end of said collecting space movable in synchronism with the movement of said first pusher means.

3. Apparatus according to claim 1 or 2 wherein said passageways are substantially vertical, the descent of the cigarettes down said passageways being uniform and at maximum speed.

* * * * *